US007471677B2

(12) United States Patent
Deshpande

(10) Patent No.: US 7,471,677 B2
(45) Date of Patent: Dec. 30, 2008

(54) SYSTEMS AND METHODS FOR IMPLEMENTING A METADATA STATION FOR AN INTERNET RADIO SERVICE

(75) Inventor: Sachin G. Deshpande, Vancouver, WA (US)

(73) Assignee: Sharp Laboratories of America, Inc., Camas, WA (US)

( * ) Notice: Subject to any disclaimer, the term of this patent is extended or adjusted under 35 U.S.C. 154(b) by 746 days.

(21) Appl. No.: 11/047,146

(22) Filed: Jan. 31, 2005

(65) Prior Publication Data

US 2006/0171395 A1 Aug. 3, 2006

(51) Int. Cl.
*H04L 12/28* (2006.01)

(52) U.S. Cl. ..... 370/389; 370/352; 709/231; 709/217

(58) Field of Classification Search ..... None
See application file for complete search history.

(56) References Cited

U.S. PATENT DOCUMENTS

| | | | | |
|---|---|---|---|---|
| 6,434,621 | B1 | 8/2002 | Pezzillo et al. | |
| 6,710,815 | B1 | 3/2004 | Billmaier et al. | |
| 2001/0030667 | A1 | 10/2001 | Kelts | |
| 2002/0152278 | A1* | 10/2002 | Pontenzone et al. | 709/217 |
| 2002/0184180 | A1* | 12/2002 | Debique et al. | 707/1 |
| 2003/0061615 | A1 | 3/2003 | Van Der Meulen | |
| 2003/0074421 | A1 | 4/2003 | Kusano et al. | |
| 2003/0179283 | A1 | 9/2003 | Seidel et al. | |
| 2006/0153103 | A1* | 7/2006 | Sato | 370/270 |
| 2007/0124428 | A1* | 5/2007 | Stampfl | 709/219 |

FOREIGN PATENT DOCUMENTS

| | | |
|---|---|---|
| JP | 2004-264360 | 9/2004 |
| WO | WO-02/067579 | 8/2002 |
| WO | 03/005679 | 1/2003 |
| WO | WO-03/067467 | 8/2003 |
| WO | WO-2004/040416 | 5/2004 |
| WO | WO-2004/072946 | 8/2004 |

OTHER PUBLICATIONS

Radio@AOL website, http://www.aol.com, 2005.
Netscape Radio website, http:// channels.netscape.com/ns/music/radio/default.jsp, 2005.
RealNetworks RealOne Player website, http://www.real.com, 2005.
Windows Media website, http://www.windowsmedia.com, 2005.

* cited by examiner

*Primary Examiner*—Bob A Phunkulh
(74) *Attorney, Agent, or Firm*—Madson & Austin

(57) ABSTRACT

Systems and methods for implementing a metadata station for an internet radio service are disclosed. An exemplary method involves exposing a plurality of Internet radio stations and a metadata station. Requests are received for the metadata station. The Internet radio stations that will have metadata information included in the metadata station are selected. The metadata information for the selected Internet radio stations is obtained, and the metadata information for the selected Internet radio stations is sent on the metadata station.

25 Claims, 8 Drawing Sheets

SYSTEMS AND METHODS FOR IMPLEMENTING A METADATA STATION FOR AN INTERNET RADIO SERVICE

TECHNICAL FIELD

The present invention relates generally to computers and computer-related technology. More specifically, the present invention relates to systems and methods for implementing a metadata station for an Internet radio service.

BACKGROUND

There are two general approaches to Internet radio. In the first approach, the programs to be broadcast on an Internet radio station are prerecorded and stored on disk. Listeners can connect to the radio station's archives and pull up any program and download it for listening. The second approach to Internet radio involves streaming live over the Internet. Some stations broadcast over the air and over the Internet simultaneously, but there are increasingly many stations that are Internet only.

Internet radio programming offers a wide spectrum of broadcast genres, particularly in music. The cost of getting "on the air" is less for an Internet broadcaster, and Internet radio can appeal to "micro-communities" of listeners focused on special music or interests.

Internet radio, however, is not limited to audio. An Internet radio broadcast may be accompanied by photos, graphics, text, and links, as well as interactivity, such as message boards and chat rooms. This allows a listener to do more than simply listen to a radio station. For example, a listener who hears an advertisement for a computer printer may order that printer through a link on the Internet radio broadcast website. It is possible for the relationship between advertisers and consumers to become more interactive on Internet radio broadcasts.

For quite some time, the only way to obtain radio broadcasts over the Internet was through a personal computer. However, it is generally envisioned that wireless connectivity will feed Internet broadcasts to car radios, PDAs, cell phones, and the like. The next generation of wireless devices will greatly expand the reach and convenience of Internet radio.

Currently a number of Internet radio services exist. For example, AOL supports the Radio@AOL service, which has a number of Internet radio stations. As another example, Radio@Netscape also supports multiple Internet radio stations. The RealOne player supports a variety of free and superpass radio channels. The Windows Media player has a radio tuner which allows tuning into number of radio stations.

An Internet radio station typically sends metadata information about the currently playing content (e.g., song, news program, sports program, etc.) to the client. Some Internet radio services also send brief information about the upcoming content on the current radio station. Other currently supported features include the ability for a user to mouse-over a radio station in the station list to find out the name of the currently playing song on that station.

In view of the foregoing, benefits may be realized by systems and methods for implementing a metadata station for an Internet radio service.

BRIEF DESCRIPTION OF THE DRAWINGS

Exemplary embodiments of the invention will become more fully apparent from the following description and appended claims, taken in conjunction with the accompanying drawings. Understanding that these drawings depict only exemplary embodiments and are, therefore, not to be considered limiting of the invention's scope, the exemplary embodiments of the invention will be described with additional specificity and detail through use of the accompanying drawings in which:

DETAILED DESCRIPTION

Figure 1:
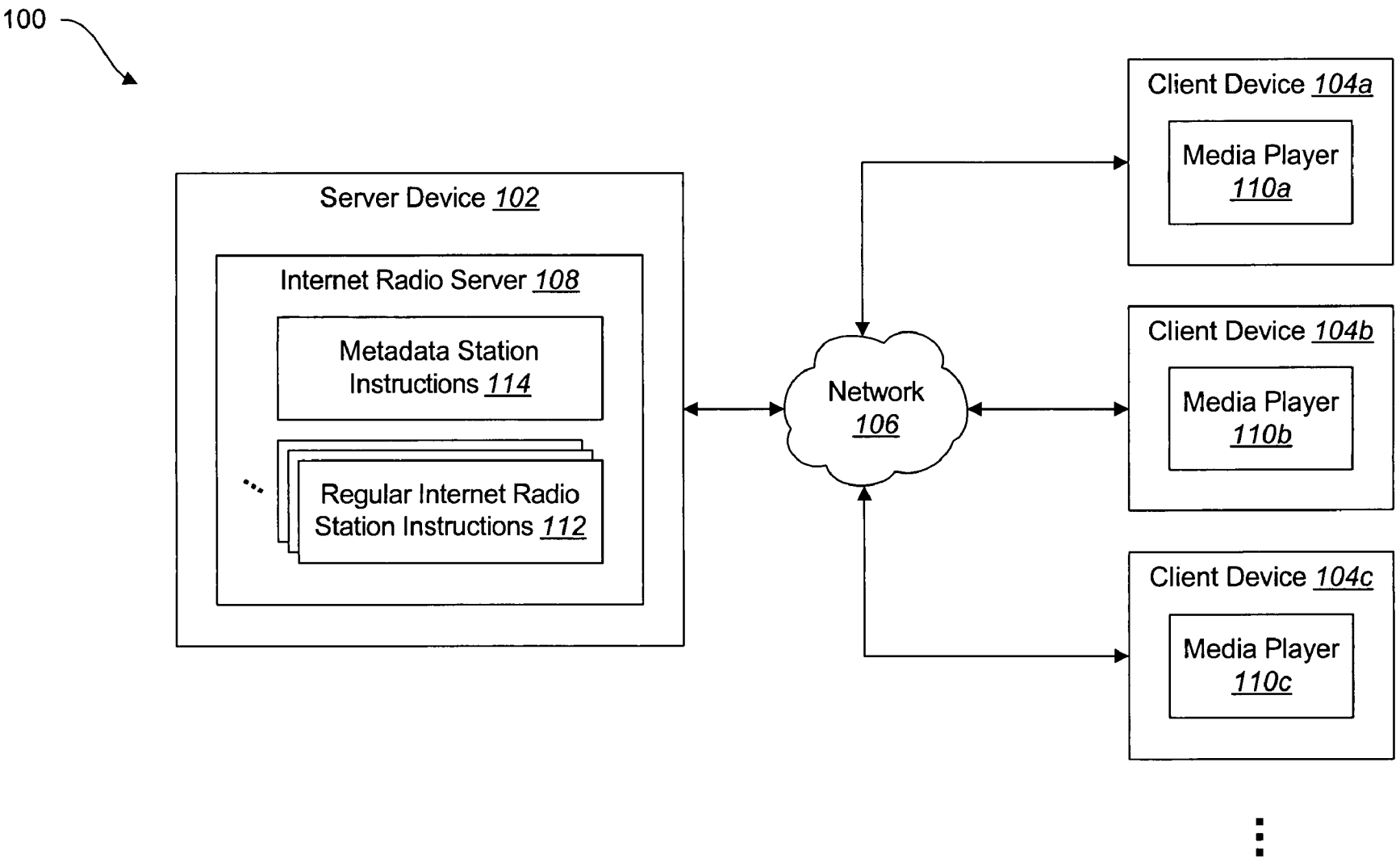
FIG. 1 illustrates an exemplary system in which some embodiments may be practiced.

A computer-readable medium for storing program data is disclosed. The program data includes executable instructions for implementing a method in a computing device. The method involves exposing a plurality of Internet radio stations and a metadata station. The method also involves receiving requests for the metadata station. The method also involves selecting the Internet radio stations that will have metadata information included in the metadata station. The method also involves obtaining the metadata information for the selected Internet radio stations. The method also involves sending the metadata information for the selected Internet radio stations on the metadata station.

The metadata station may send the metadata information about current content that is playing, past content that was played, and/or future content that is going to be played on the selected Internet radio stations. In some embodiments, the metadata station does not send other content. In other embodiments, however, the metadata station also sends other content. The metadata information may be selected from the group consisting of information about media data that is playing, was played, or is going to be played on at least one of the selected Internet radio stations, the title of the media data, the album corresponding to the media data, the artist corresponding to the media data, one or more links to the information about the media data, an image corresponding to the media data, references to the selected Internet radio stations, one or more links to buy the media data, a time when playback of a media data item started, a duration of the media data item, a remaining duration of the media data item, a bit-rate of the media data item, a format of the media data item, payload information of the media data item, and a rating or rank of the media data item.

In some embodiments, the method may also involve monitoring the selected Internet radio stations. The method may also involve detecting a change in content playing on an Internet radio station. The method may also involve, in response to detecting the change in the content, obtaining the metadata information for the new content. The method may also involve sending the metadata information for the new content on the metadata station.

The metadata information for the selected regular Internet radio stations may be sent on the metadata station in a cyclic manner. Alternatively, the metadata information for the selected regular Internet radio stations may be sent on the metadata station at periodic intervals.

The method may also involve defining an interface for receiving the metadata information for the selected Internet radio stations. In some embodiments, the interface is a multicast group.

In some embodiments, selecting the Internet radio stations that will have metadata information included in the metadata station involves selecting all of the plurality of Internet radio stations. Alternatively, this may involve automatically selecting a subset of the plurality of Internet radio stations. Alternatively, this may involve automatically selecting Internet radio stations of a same genre. Alternatively, this may involve automatically selecting a user's favorite preset Internet radio stations. Alternatively, this may involve allowing a user to select some or all of the plurality of Internet radio stations.

A computing device is also disclosed. The computing device includes a processor and memory in electronic communication with the processor. Instructions are stored in the memory. The instructions are executable to implement a method that involves exposing a plurality of Internet radio stations and a metadata station. The method also involves receiving requests for the metadata station. The method also involves selecting the Internet radio stations that will have metadata information included in the metadata station. The method also involves obtaining the metadata information for the selected Internet radio stations. The method also involves sending the metadata information for the selected Internet radio stations on the metadata station.

A method in a computing device is also disclosed. The method involves exposing a plurality of Internet radio stations and a metadata station. The method also involves receiving requests for the metadata station. The method also involves selecting the Internet radio stations that will have metadata information included in the metadata station. The method also involves obtaining the metadata information for the selected Internet radio stations. The method also involves sending the metadata information for the selected Internet radio stations on the metadata station.

Various embodiments of the invention are now described with reference to the Figures, where like reference numbers indicate identical or functionally similar elements. It will be readily understood that the embodiments of the present invention, as generally described and illustrated in the Figures herein, could be arranged and designed in a wide variety of different configurations. Thus, the following more detailed description of several exemplary embodiments of the present invention, as represented in the Figures, is not intended to limit the scope of the invention, as claimed, but is merely representative of the embodiments of the invention.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

Several aspects of the embodiments described herein will be illustrated as software components stored in a computing device. As used herein, a software component may include any type of computer instruction or computer executable code located within a memory device and/or transmitted as electronic signals over a system bus or network. A software component may, for instance, comprise one or more physical or logical blocks of computer instructions, which may be organized as a routine, program, object, data structure, etc., that performs one or more tasks or implements particular abstract data types.

In certain embodiments, a particular software component may comprise disparate instructions stored in different locations of a memory device, which together implement the described functionality of the component. Indeed, a software component may comprise a single instruction, or many instructions, and may be distributed over several different code segments, among different programs, and across several memory devices. Some embodiments may be practiced in a distributed computing environment where tasks are performed by a remote processing device linked through a communications network. In a distributed computing environment, different portions of the same software component may be located in local and/or remote memory storage devices.

FIG. 1 illustrates an exemplary system 100 in which some embodiments may be practiced. As shown, embodiments disclosed herein may involve interaction between a server device 102 and one or more client devices 104. The system 100 shown in FIG. 1 includes a first client device 104*a*, a second client device 104*b*, a third client device 104*c*, and so on. Communication between the server device 102 and the client devices 104 may occur via one or more computer networks 106, such as the Internet.

The server device 102 includes an Internet radio server 108. The Internet radio server 108 is a software component, as that term is defined above. The Internet radio server 108 implements an Internet radio service. More specifically, the Internet radio server 108 exposes a number of Internet radio stations to client devices 104. The Internet radio stations may stream a wide variety of content, including music, sports, news, and so forth.

Each client device 104 includes a media player 110. Each media player 110 is configured to communicate with the Internet radio server 108 in order to receive Internet radio station data and play those stations to a user. Examples of media players 110 include Windows Media Player™, RealPlayer™, etc.

The Internet radio server 108 includes instructions 112 for exposing a number of "regular" Internet radio stations. In addition, the Internet radio server 108 also includes instructions 114 for exposing one or more metadata stations. The metadata station sends metadata information about the current content that is playing, the past content that was played, and/or the future content that is going to be played on some or all of the regular Internet radio stations. The metadata station may not send other kinds of content. In some embodiments, the metadata station may also send media data. The metadata information that is sent on the metadata station is created by the Internet radio server 108 based on the metadata of the current content that is playing, the past content that was played, and/or the future content that is going to be played on the regular radio station(s) supported by the server 108. A user of a media player 110 on a client device 104 can tune to a regular Internet radio station by taking some action (e.g., pressing a key on a remote control, clicking a mouse button, pressing a key on a keyboard, etc.) when the metadata for that station is being shown on the metadata station.

For example, suppose the Internet radio server 108 supports three Internet radio stations. (Of course, some Internet radio servers support many more Internet radio stations, but for simplicity, three will be used in this example.) Station A is currently playing song A, station B is currently playing song B, and station C is currently playing song C. In this example, the metadata station would send metadata information about song A, song B, and song C. The metadata station may send only metadata for song A, song B, and song C or it may also send the media data for these songs or about these songs. A user of a media player 110 that is receiving the metadata station can then determine whether to listen to station A, station B, or station C based on the metadata information which describes the current content that is playing on those stations. If the user likes song A better than song B or song C, the user may then tune to station A and start listening to song A.

The metadata information about the current content of an Internet radio station may include some or all of the following: information about a currently playing song (e.g., the title, artist, album name, etc.); album art for a currently playing song (e.g., an image from the song's album); the name and reference (URL) to the corresponding Internet radio station; links to (or actual) detailed information about the currently playing song; links to (or actual) detailed information for the artist and/or album corresponding to the currently playing song; a link to directly buy the currently playing song; the time and date when song playback started; the duration of the song; the remaining duration of the song (in case playback has already started); the bit-rate, format, other media payload information; actual media payload for the song; song rating/rank; or other information. The metadata information may also include information about content other than songs. For example, if a talk show is playing on a particular Internet radio station, the metadata information may include the name of the talk show, the name of a guest on the talk show that is being interviewed, etc. Similar information about the past media items which have been played and/or future media items which are going to be played may be included.

Figure 2:
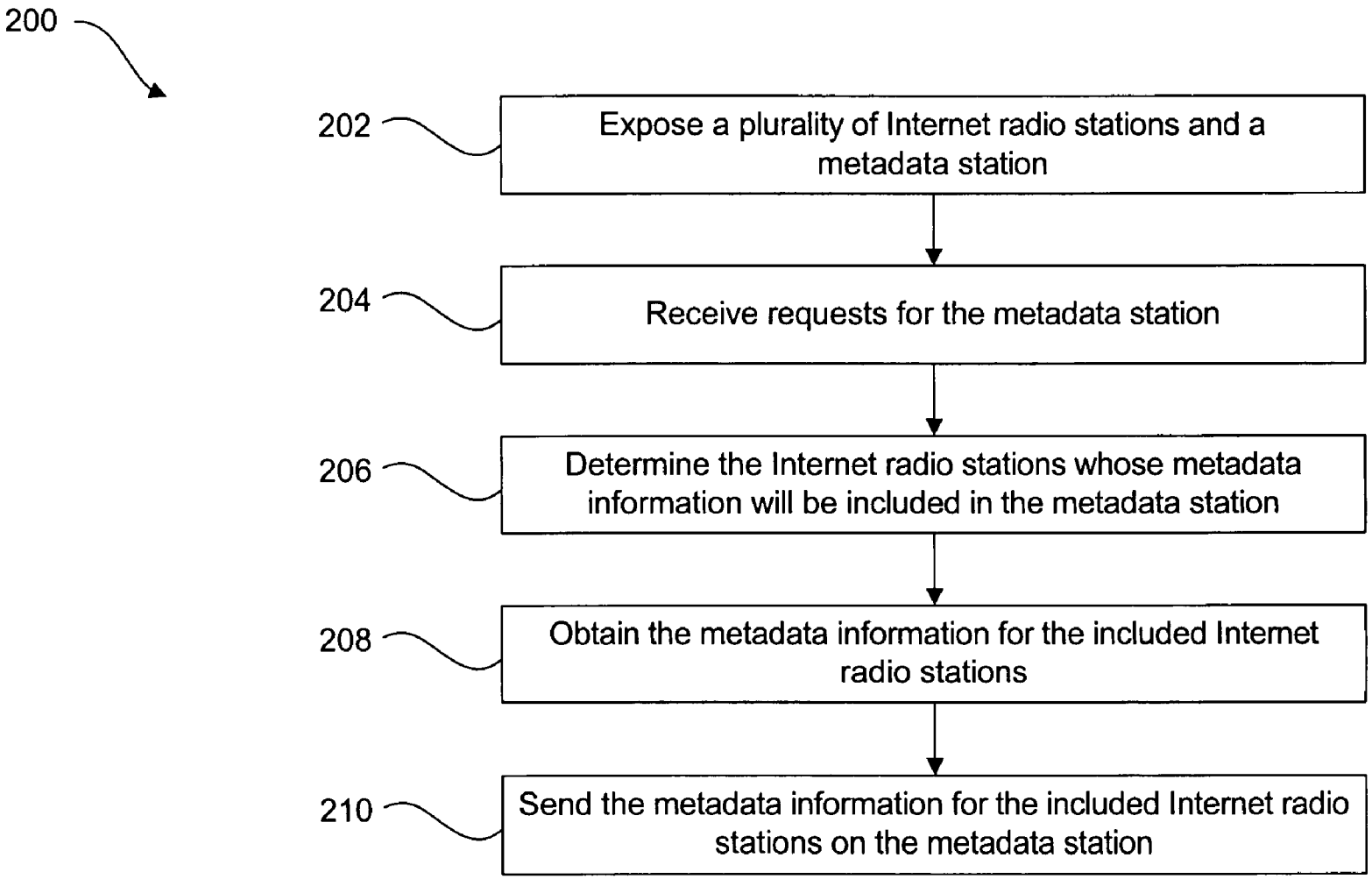
FIG. 2 illustrates an embodiment of a method that may be performed by the Internet radio server.

FIG. 2 illustrates an embodiment of a method 200 that may be performed by the Internet radio server 108. The server 108 exposes 202 a plurality of Internet radio stations and a metadata station to media players 110 on client devices 104. In some embodiments, a client media player 110 may request from the Internet radio server 108 a list of stations supported by the server 108. In response, the server 108 may transmit to the client media player 110 a list of supported stations. The list may include the metadata station in addition to other regular Internet radio stations.

The server 108 receives 204 requests for the metadata station from media players 110 on client devices 104. In response, the server 108 determines 206 the Internet radio stations whose metadata information will be included in the metadata station. For example, the metadata station may be configured to deliver metadata information for each of the regular radio stations supported by the Internet radio server 108. In other words, assuming that the Internet radio server 108 supports N Internet radio stations (other than the metadata station), the metadata station may include the metadata information for each of the N stations. Alternatively, in some embodiments the Internet radio server 108 may allow a user to select a number of stations (M) from the list of available stations that the server 108 supports. In such embodiments, the server 108 delivers the metadata information only for these selected M stations on the metadata station. Alternatively still, in some embodiments the server 108 may automatically select a number of stations (P) from the available regular stations to automatically create a metadata station for those selected (P) stations. For example, all stations belonging to a genre (e.g., pop) may be selected. As another example all the preset (favorite) stations for the user may be selected.

The server 108 obtains 208 the metadata information for the included Internet radio stations, and sends 210 the metadata information on the metadata station. The server 108 may send the metadata information in a previously agreed format (e.g., XML-based format) between the server 108 and the media player 110 on the client device 104, which requires the media player 110 to decode the information. Alternately the server 108 may send the metadata information in a video format such that the server 108 encodes and sends the video which is a screen representation for the metadata information. The server 108 may send timestamps as part of the metadata information. The metadata information about a particular Internet radio station may include information which can be used by the client to allow the user to easily switch to that radio station and start listening to the current content on that station. For example, the metadata information may include the URL of the radio station.

Figure 3:
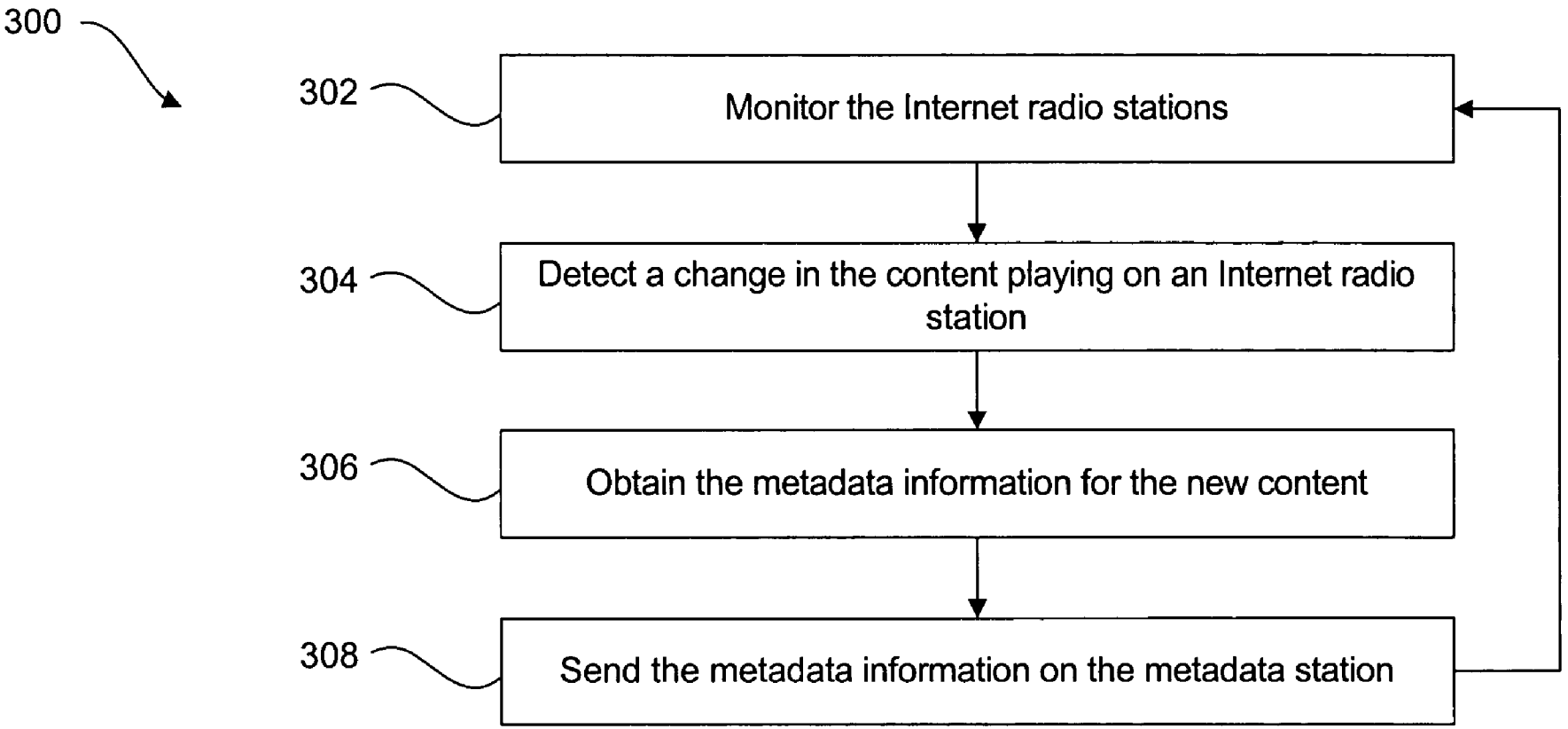
FIG. 3 illustrates another embodiment of a method that may be performed by the Internet radio server.

FIG. 3 illustrates another embodiment of a method 300 that may be performed by the Internet radio server 108. The method 300 shown in FIG. 3 illustrates one exemplary way in which the Internet radio server 108 may handle the timing of the metadata information on the metadata station.

The server 108 monitors 302 the "regular" Internet radio stations. A change in the content playing on an Internet radio station is detected 304. For example, a song that is playing on a particular Internet radio station may end, and a new song may start to be played.

In response to detecting 304 a change in the content playing on an Internet radio station, the metadata information for the new content is obtained 306 and sent 308 on the metadata station. The method 300 then returns to step 302 and proceeds as described above.

The metadata information for a particular type of content (e.g., a song) may be sent on the metadata station when the content starts playing on a regular radio station, and/or when the content is just about to start playing on a regular radio station. In some cases two or more radio stations may have (exactly or nearly) the same starting time for particular content, such as a song. In this case the server 108 may send the metadata information atomically for each individual station, so that the server 108 may send the metadata information for these radio stations successively on the metadata station.

Figure 4:
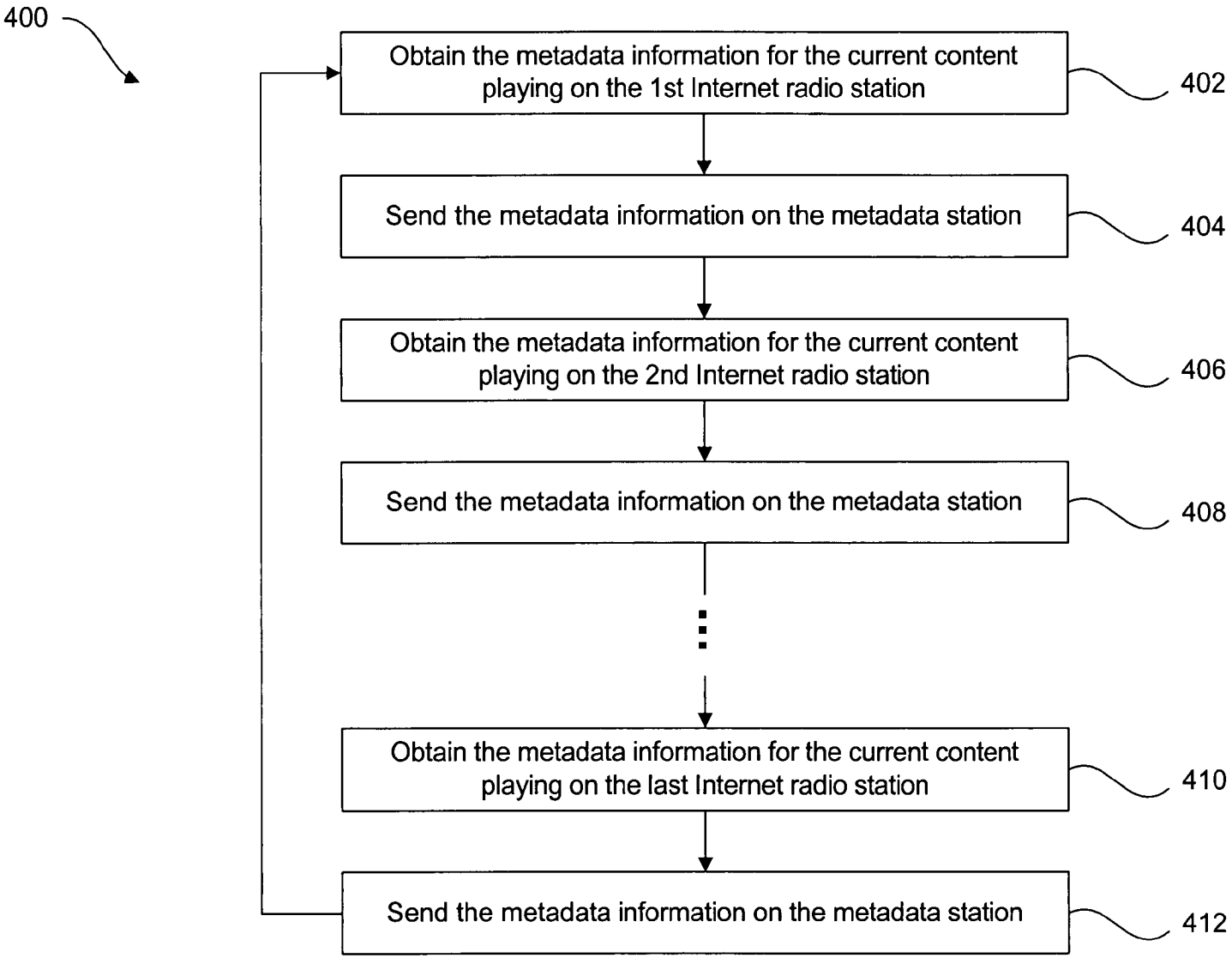
FIG. 4 illustrates another embodiment of a method that may be performed by the Internet radio server.

FIG. 4 illustrates another embodiment of a method 400 that may be performed by the Internet radio server 108. The method 400 shown in FIG. 4 illustrates another exemplary way in which the Internet radio server 108 may handle the timing of the metadata information on the metadata station.

In the illustrated embodiment, the metadata information is sent on the metadata station in a cyclic manner for all of the selected regular Internet radio stations. The cyclic order of the radio stations may be automatically created by the server or may be configured by the user. The metadata information for the current content playing on the first Internet radio station in the order of radio stations is obtained 402 and sent 404 on the metadata station. Then, the metadata information is obtained 406 and sent 408 for the current content playing on the second Internet radio station. This pattern continues, until the metadata information for the current content playing on the last Internet radio station is obtained 410 and sent 412 on the metadata station. Then the method 400 returns to step 402 and proceeds as described above. In some embodiments the metadata information for an Internet radio station may not be sent if the same information is sent once already in the previous cycle for that station.

Figure 5:
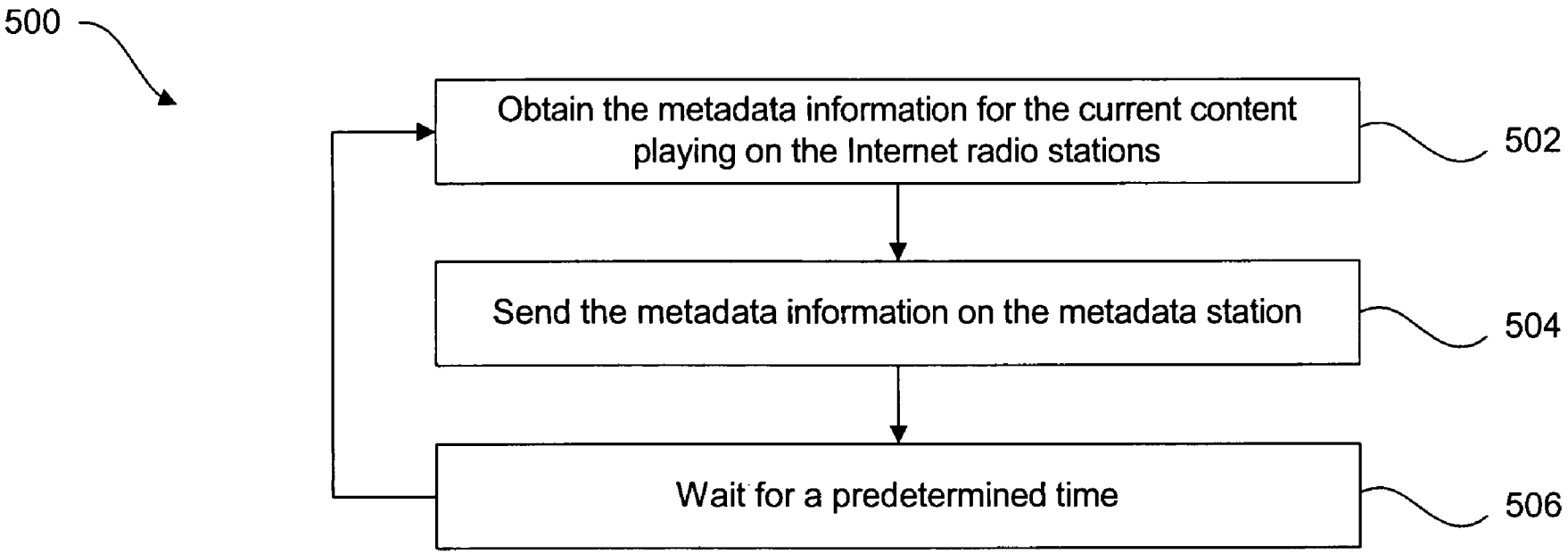
FIG. 5 illustrates another embodiment of a method that may be performed by the Internet radio server.

FIG. 5 illustrates another embodiment of a method 500 that may be performed by the Internet radio server 108. The method 500 shown in FIG. 5 illustrates another exemplary way in which the Internet radio server 108 may handle the timing of the metadata information on the metadata station.

In the illustrated embodiment, the server 108 sends the metadata information for each radio station at periodic intervals. More specifically, the metadata information for the current content playing on the Internet radio stations is obtained 502 and sent 504 on the metadata station. The server 108 then waits 506 for a predetermined time. The method 500 then returns to step 502 and proceeds as described above.

The period of time that the server 108 waits between sending metadata information may be fixed by the server 108 and/or may be configurable by the media player 110 on the client device 104 (typically within some limits and min-max restrictions based on the current song duration). In some embodiments, this approach may be used by the server 108 when it is using the cyclic order for sending the metadata information (described above in connection with FIG. 4).

Also, in some embodiments, the server 108 may notify the media players 110 on the client devices 104 of the frequency/rate at which the server 108 will send the metadata information.

Figure 6:
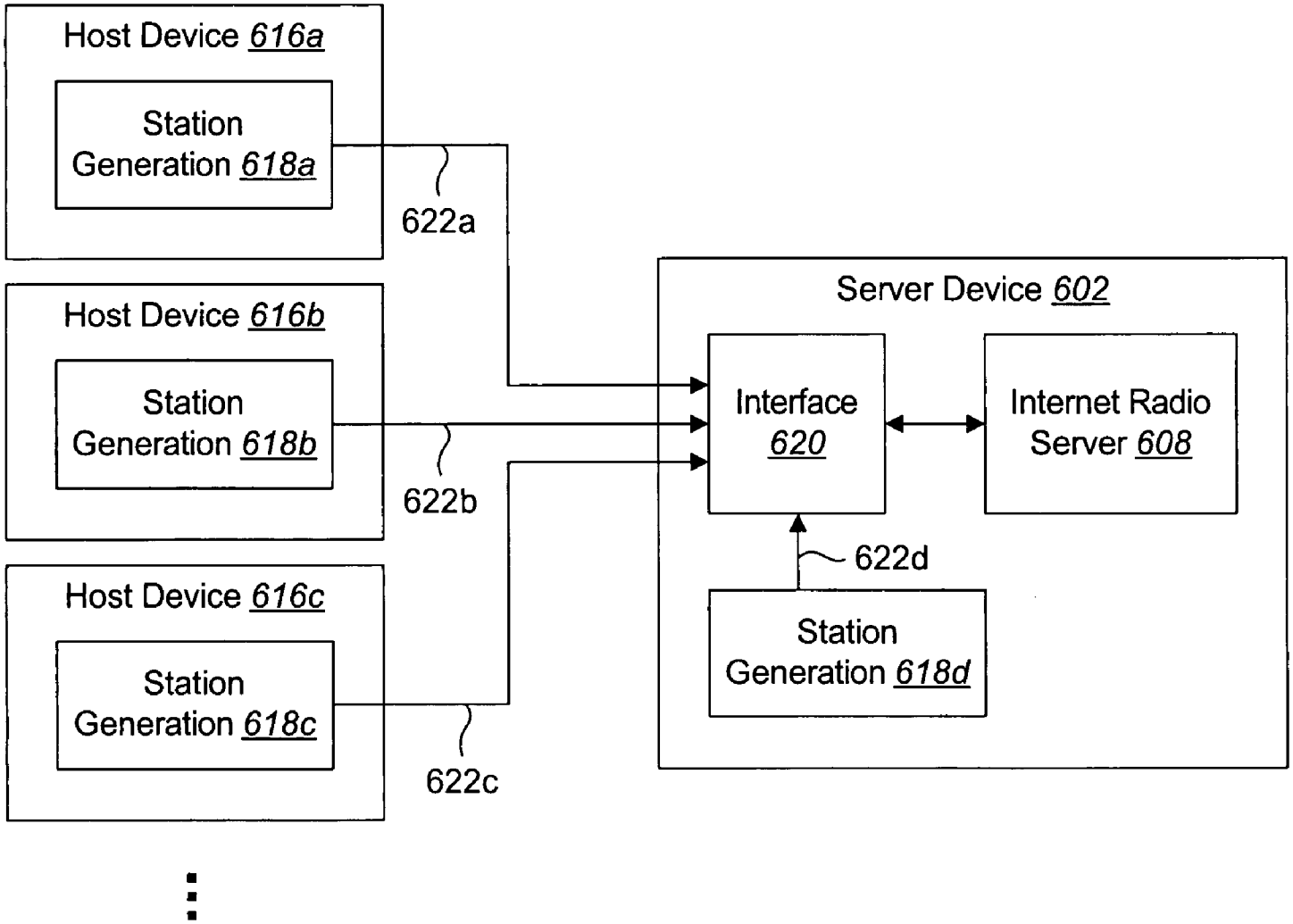
FIG. 6 illustrates an exemplary architecture which may be used to obtain the metadata information for the Internet radio stations.

The methods disclosed herein involve obtaining metadata information for some or all of the Internet radio stations supported by the Internet radio server 108. FIG. 6 illustrates an exemplary architecture which may be used to obtain the metadata information for the Internet radio stations. In the exemplary architecture shown in FIG. 6, the server device 602 is in electronic communication with one or more host devices 616, including a first host device 616*a*, a second host device 616*b*, a third host device 616*c*, and so on.

Each host device 616 includes a station generation component 618. More specifically, the first host device 616*a* includes a first station generation component 618*a*, the second host device 616*b* includes a second station generation component 618, the third host device 618*c* includes a third station generation component 618*c*, and so on.

Each station generation component 618 is a software component, as that term is defined above. Each station generation component 618 generates a data stream corresponding to a particular Internet radio station. Each station generation component 618 may include one or more programs for generating an audio signal, an automation program for converting audio segments into an audio signal, an encoder, etc. The data stream corresponding to a particular Internet radio station may include the current, past and/or future content for that Internet radio station as well as the metadata information about the current, past and/or future content.

The Internet radio server 608 on the server device 602 defines an interface 620 for receiving the metadata information 622 corresponding to the different Internet radio stations supported by the Internet radio server 608. The metadata information 622 from the different radio stations is transmitted from the station generation components 618 on the different host devices 616 to this interface 620. More specifically, the metadata information 622*a* from the first Internet radio station is transmitted from the first station generation component 618*a* on the first host device 616*a* to the interface 620, the metadata information 622*b* from the second Internet radio station is transmitted from the second station generation component 618*b* on the second host device 616*b* to the interface 620, the metadata information 622*c* from the third Internet radio station is transmitted from the third station generation component 618*c* on the third host device 616*c* to the interface 620, and so on.

The server device 602 may also include a station generation component 618*d*. The station generation component 618*d* on the server device 602 also generates a data stream corresponding to a particular Internet radio station. This data stream also includes the metadata information about the content that is currently playing on that station. The station generation component 618*d* on the server device 602 may provide the metadata information 622*d* for this station to the Internet radio server 608 via the defined interface 620.

In alternative embodiments, the server device 602 may include multiple station generation components 618 which generate multiple data streams corresponding to multiple Internet radio stations. The metadata information 622 from each of the data streams may be provided to the Internet radio server 608 via the defined interface 620.

In some embodiments, the server device 602 and the host devices 616 may be part of a multicast group. In such embodiments, the interface 620 that is defined by the Internet radio server 608 for receiving the metadata information for the different Internet radio stations may be the multicast group. Thus, the server 108 may receive the metadata information 622 for all the radio stations by simply listening to this multicast group.

Figure 7:
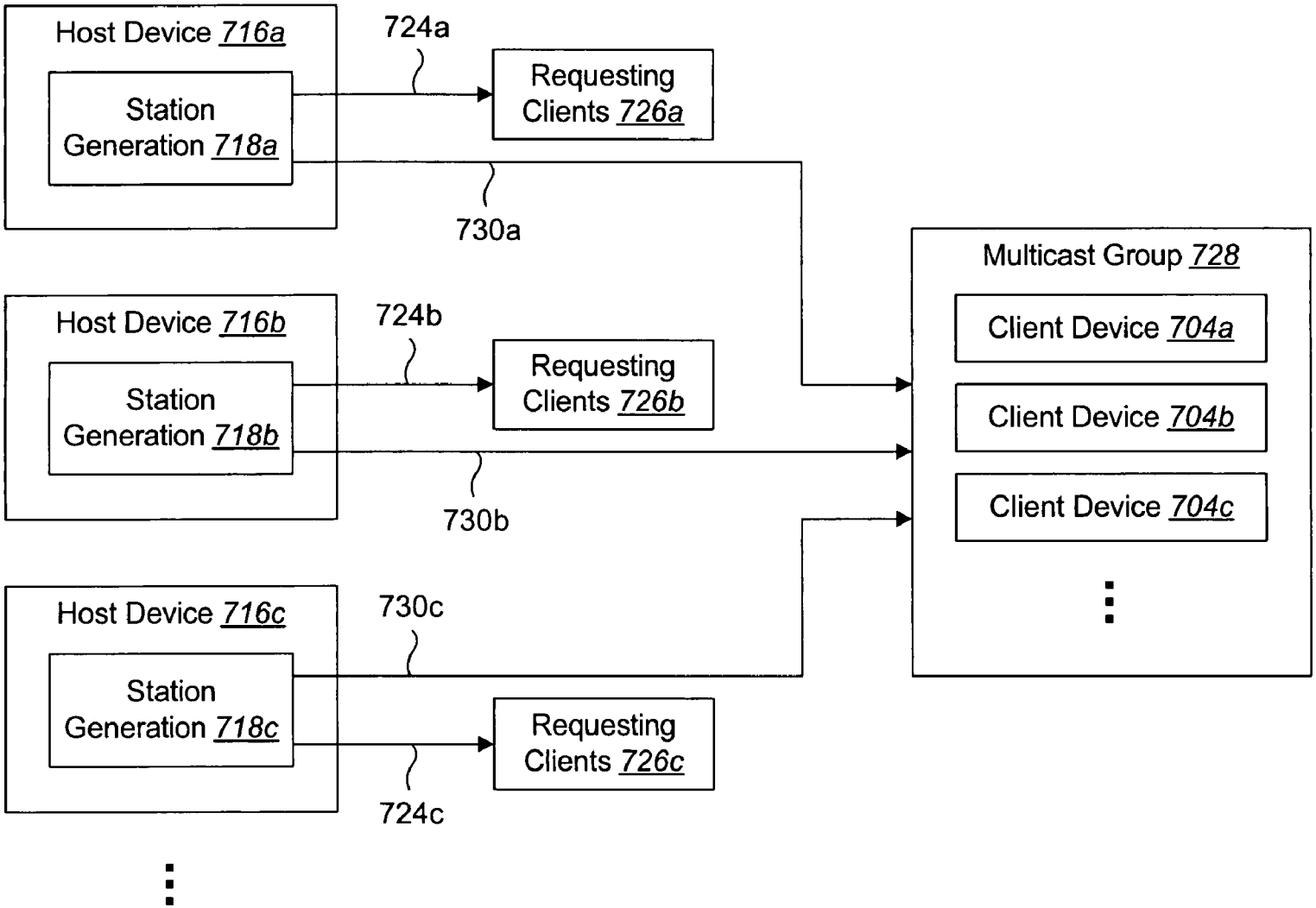
FIG. 7 illustrates another exemplary architecture which may be used to obtain the metadata information for the Internet radio stations.

FIG. 7 illustrates another exemplary architecture which may be used to obtain the metadata information for the Internet radio stations. The architecture shown in FIG. 7 includes a plurality of host devices 716. Specifically, the architecture includes a first host device 716*a*, a second host device 716*b*, a third host device 716*c*, and so on.

Each host device 716 includes a station generation component 718. The first host device 716*a* includes a first station generation component 718*a*, the second host device 716*b* includes a second station generation component 718*b*, the third host device 716*c* includes a third station generation component 718*c*, and so on.

As before, each station generation component 718 generates a data stream corresponding to a particular Internet radio station. The data stream corresponding to a particular Internet radio station includes the content for that Internet radio station as well as the metadata information about the current, past and/or future content. The first station generation component 718*a* generates a first data stream 724*a* corresponding to a first Internet radio station, the second station generation component 718*b* generates a second data stream 724*b* corresponding to a second Internet radio station, the third station generation component 618*c* generates a third data stream 724*c* corresponding to a third Internet radio station, and so on.

The data stream 724 corresponding to a particular Internet radio station is transmitted to client devices that have requested that radio station. Thus, the first data stream 724*a* is sent to a first set 726*a* of client devices that have requested the first Internet radio station, the second data stream 724*b* is sent to a second set 726*b* of client devices that have requested the second Internet radio station, the third data stream 724*c* is sent to a third set 726*c* of client devices that have requested the third Internet radio station, and so on.

A number of client devices 704*a*, 704*b*, 704*c*, etc., have requested the metadata station. The client devices 704 that have requested the metadata station are part of a multicast group 728. When a data stream 724 corresponding to a particular radio station is being transmitted to clients 726 that have requested that station, the metadata information 730 from that data stream is sent to the multicast group 728. More specifically, the metadata information 730*a* from the first data stream 724*a* is sent to the multicast group 728 when the first data stream 724*a* is sent to the set 726*a* of client devices that have requested the first Internet radio station. The metadata information 730*b* from the second data stream 724*b* is sent to the multicast group 728 when the second data stream 724*b* is sent to the set 726*b* of client devices that have requested the second Internet radio station. The metadata information 730*c* from the third data stream 724*c* is sent to the multicast group 728 when the third data stream 724*c* is sent to the set 726*c* of client devices that have requested the third Internet radio station. Thus, in this architecture, the multicast group 728 is the metadata station.

The embodiments of the metadata station disclosed herein are different from an electronic program guide ("EPG") channel, which is part of some cable and/or satellite television networks. The EPG channel shows a time grid which displays the current and future programs which are "scheduled" to be broadcast. The EPG is typically pre-created and available separately and often in advance of the airings of the television shows. In contrast with this the information (content) on the metadata station may be created dynamically. In addition, in some embodiments only the information about the currently playing content (e.g., song) is sent on the metadata station. The EPG channel does not create its schedule of programs dynamically based on the information from each of the TV channels, as it changes and becomes available in real-time. In addition, the EPG channel is not created based on an architecture which consists of all the individual radio stations being part of a multicast group on which they send metadata at the same time they would send it to a client receiving the particular radio station.

Figure 8:
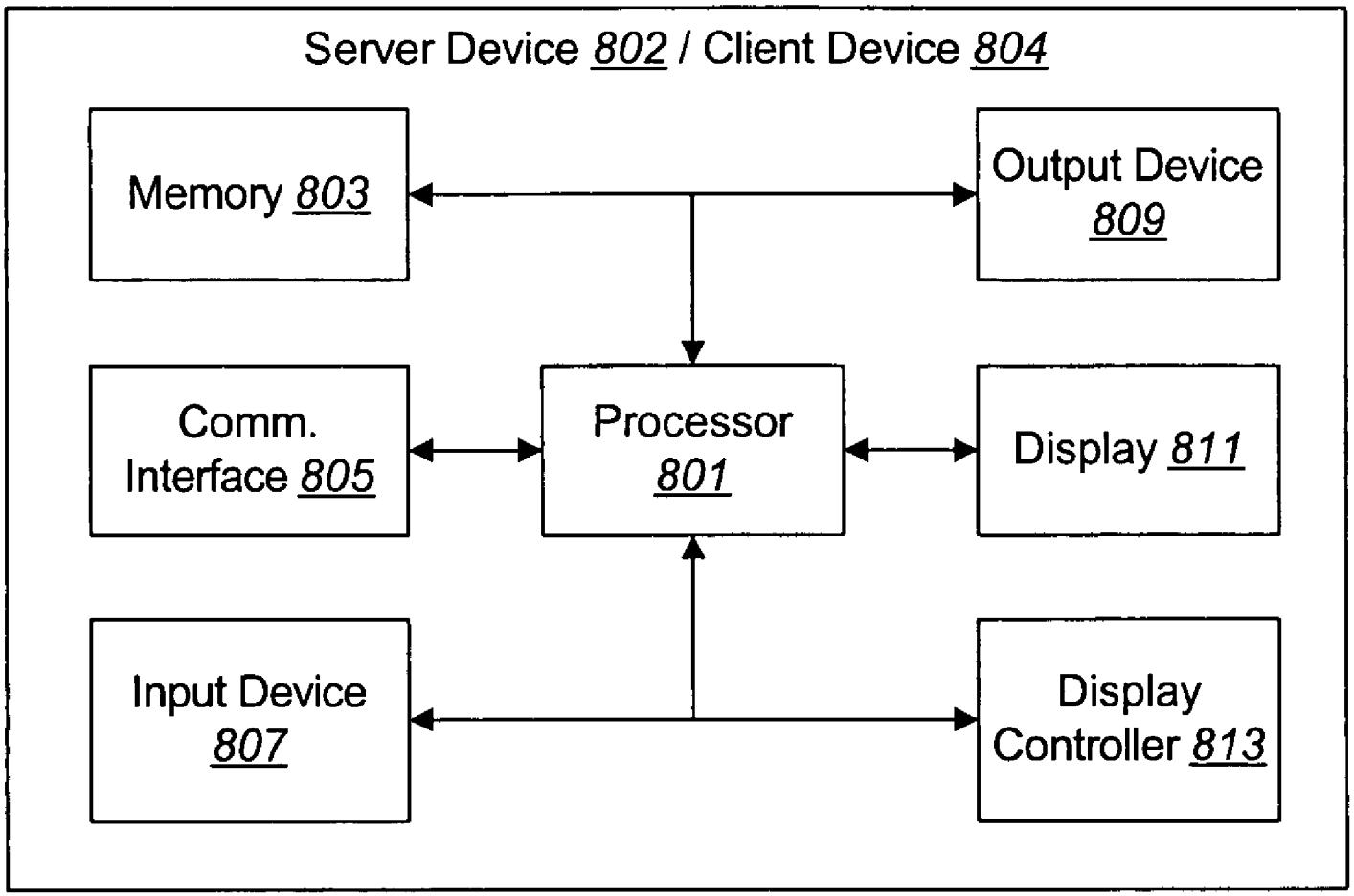
FIG. 8 is a block diagram illustrating the major hardware components typically utilized in a server device and/or a client device.

FIG. 8 is a block diagram illustrating the major hardware components typically utilized in a server device 802 and/or a client device 804. The illustrated components may be located within the same physical structure or in separate housings or structures.

The server device 802/client device 804 includes a processor 801 and memory 803. The processor 801 controls the operation of the server device 802/client device 804 and may be embodied as a microprocessor, a microcontroller, a digital signal processor (DSP) or other device known in the art. The processor 801 typically performs logical and arithmetic operations based on program instructions stored within the memory 803.

As used herein, the term "memory" 803 is broadly defined as any electronic component capable of storing electronic information, and may be embodied as read only memory (ROM), random access memory (RAM), magnetic disk storage media, optical storage media, flash memory devices in RAM, on-board memory included with the processor 801, EPROM memory, EEPROM memory, registers, etc. The memory 803 typically stores program instructions and other types of data. The program instructions may be executed by the processor 801 to implement some or all of the methods disclosed herein.

The server device 802/client device 804 typically also includes one or more communication interfaces 805 for communicating with other electronic devices. The communication interfaces 805 may be based on wired communication technology, wireless communication technology, or both. Examples of different types of communication interfaces 805 include a serial port, a parallel port, a Universal Serial Bus (USB), an Ethernet adapter, an IEEE 1394 bus interface, a small computer system interface (SCSI) bus interface, an infrared (IR) communication port, a Bluetooth wireless communication adapter, and so forth.

The server device 802/client device 804 typically also includes one or more input devices 807 and one or more output devices 809. Examples of different kinds of input devices 807 include a keyboard, mouse, microphone, remote control device, button, joystick, trackball, touchpad, lightpen, etc. Examples of different kinds of output devices 809 include a speaker, printer, etc. One specific type of output device which is typically included in a computer system is a display device 811. Display devices 811 used with embodiments disclosed herein may utilize any suitable image projection technology, such as a cathode ray tube (CRT), liquid crystal display (LCD), light-emitting diode (LED), gas plasma, electroluminescence, or the like. A display controller 813 may also be provided, for converting data stored in the memory 803 into text, graphics, and/or moving images (as appropriate) shown on the display device 811.

Of course, FIG. 8 illustrates only one possible configuration of a server device 802/client device 804. Those skilled in the art will recognize that various other architectures and components may be utilized. In addition, various standard components are not illustrated in order to avoid obscuring aspects of the invention.

While specific embodiments and applications of the present invention have been illustrated and described, it is to be understood that the invention is not limited to the precise configuration and components disclosed herein. Various modifications, changes, and variations which will be apparent to those skilled in the art may be made in the arrangement, operation, and details of the methods and systems of the present invention disclosed herein without departing from the spirit and scope of the invention.

What is claimed is:

1. A computer-readable medium for a server computing device, the computer-readable medium comprising executable instructions for:

exposing a plurality of Internet radio stations and a metadata station;

receiving requests for the metadata station;

selecting the Internet radio stations that will have metadata information included in the metadata station;

obtaining the metadata information for the selected Internet radio stations;

sending the metadata information for the selected Internet radio stations on the metadata station to one or more client devices;

monitoring the selected Internet radio stations;

detecting a change in content playing on an Internet radio station;

in response to detecting the change in the content, obtaining the metadata information for the new content; and sending the metadata information for the new content on the metadata station.

2. The computer-readable medium of claim 1, wherein the metadata station sends the metadata information about current content that is playing, past content that was played, and/or future content that is going to be played on the selected Internet radio stations, and wherein the metadata station does not send other content.

3. The computer-readable medium of claim 1, wherein the metadata station sends the metadata information about current content that is playing, past content that was played, and/or future content that is going to be played on the selected Internet radio stations, and wherein the metadata station also sends other content.

4. The computer-readable medium of claim 1, wherein the metadata information is selected from the group consisting of information about media data that is playing, was played, or is going to be played on at least one of the selected Internet radio stations, a title of the media data, an album corresponding to the media data, an artist corresponding to the media data, one or more links to the information about the media data, an image corresponding to the media data, references to the selected Internet radio stations, one or more links to buy the media data, a time when playback of a media data item staffed, a duration of the media data item, a remaining duration of the media data item, a bit-rate of the media data item, a format of the media data item, payload information of the media data item, and a rating or rank of the media data item.

5. The computer-readable medium of claim 1, wherein the metadata information for the selected regular Internet radio stations is sent on the metadata station in a cyclic manner.

6. The computer-readable medium of claim 1, wherein the metadata information for the selected regular Internet radio stations is sent on the metadata station at periodic intervals.

7. The computer-readable medium of claim 1, wherein the method further comprises defining an interface for receiving the metadata information for the selected Internet radio stations.

8. The computer-readable medium of claim 7, wherein the interface is a multicast group.

9. The computer-readable medium of claim 1, wherein selecting the Internet radio stations that will have metadata information included in the metadata station comprises selecting all of the plurality of Internet radio stations.

10. The computer-readable medium of claim 1, wherein selecting the Internet radio stations that will have metadata information included in the metadata station comprises automatically selecting a subset of the plurality of Internet radio stations.

11. The computer-readable medium of claim 1, wherein selecting the Internet radio stations that will have metadata information included in the metadata station comprises automatically selecting Internet radio stations of a same genre.

12. The computer-readable medium of claim 1, wherein selecting the Internet radio stations that will have metadata information included in the metadata station comprises automatically selecting a user's favorite preset Internet radio stations.

13. The computer-readable medium of claim 1, wherein selecting the Internet radio stations that will have metadata information included in the metadata station comprises allowing a user to select some or all of the plurality of Internet radio stations.

14. A server computing device, comprising:

a processor;

memory in electronic communication with the processor;

instructions stored in the memory, the instructions being executable to:

expose a plurality of Internet radio stations and a metadata station;

receive requests for the metadata station;

select the Internet radio stations that will have metadata information included in the metadata station;

obtain the metadata information for the selected Internet radio stations;

send the metadata information for the selected Internet radio stations on the metadata station to one or more client devices:

monitor the selected Internet radio stations;

detect a change in content playing on an Internet radio station;

in response to detecting the change in the content, obtain the metadata information for the new content; and send the metadata information for the new content on the metadata station

15. The computing device of claim 14, wherein the metadata station sends the metadata information about current content that is playing, past content that was played, and/or future content that is going to be played on the selected Internet radio stations, and wherein the metadata station does not send other content.

16. The computing device of claim 14, wherein the metadata station sends the metadata information about current content that is playing, past content that was played, and/or future content that is going to be played on the selected Internet radio stations, and wherein the metadata station also sends other content.

17. The computing device of claim 14, wherein the metadata information is selected from the group consisting of information about media data that is playing, was played, or is going to be played on at least one of the selected Internet radio stations, a title of the media data, an album corresponding to the media data, an artist corresponding to the media data, one or more links to the information about the media data, an image corresponding to the media data, references to the selected Internet radio stations, one or more links to buy the media data, a time when playback of a media data item staffed, a duration of the media data item, a remaining duration of the media data item, a bit-rate of the media data item, a format of the media data item, payload information of the media data item, and a rating or rank of the media data item.

18. The computing device of claim 14, wherein the metadata information for the selected regular Internet radio stations is sent on the metadata station in a cyclic manner.

19. The computing device of claim 14, wherein the metadata information for the selected regular Internet radio stations is sent on the metadata station at periodic intervals.

20. In a server computing device, a method comprising:

exposing a plurality of Internet radio stations and a metadata station;

receiving requests for the metadata station;

selecting the Internet radio stations that will have metadata information included in the metadata station;

obtaining the metadata information for the selected Internet radio stations;

sending the metadata information for the selected Internet radio stations on the metadata station;

monitoring the selected Internet radio stations;

detecting a change in content playing on an Internet radio station;

in response to detecting the change in the content, obtaining the metadata information for the new content; and sending the metadata information for the new content on the metadata station.

21. The method of claim 20, wherein the metadata station sends the metadata information about current content that is playing, past content that was played, and/or future content that is going to be played on the selected Internet radio stations, and wherein the metadata station does not send other content.

22. The method of claim 20, wherein the metadata station sends the metadata information about current content that is playing, past content that was played, and/or future content that is going to be played on the selected Internet radio stations, and wherein the metadata station also sends other content.

23. The method of claim 20, wherein the metadata information is selected from the group consisting of information about media data that is playing, was played, or is going to be played on at least one of the selected Internet radio stations, a title of the media data, an album corresponding to the media data, an artist corresponding to the media data, one or more links to the information about the media data, an image corresponding to the media data, references to the selected Internet radio stations, one or more links to buy the media data, a time when playback of a media data item started, a duration of the media data item, a remaining duration of the media data item, a bit-rate of the media data item, a format of the media data item, payload information of the media data item, and a rating or rank of the media data item.

24. The method of claim 20, wherein the metadata information for the selected regular Internet radio stations is sent on the metadata station in a cyclic manner.

25. The method of claim 20, wherein the metadata information for the selected regular Internet radio stations is sent on the metadata station at periodic intervals.

* * * * *

UNITED STATES PATENT AND TRADEMARK OFFICE

CERTIFICATE OF CORRECTION

PATENT NO. : 7,471,677 B2
APPLICATION NO. : 11/047146
DATED : December 30, 2008
INVENTOR(S) : Sachin G. Deshpande It is certified that error appears in the above-identified patent and that said Letters Patent is hereby corrected as shown below:

Claim 4 in Column 10, line 46, please replace “staffed” with --started--.
Claim 17 in Column 12, line 1, please replace “staffed” with --started--.

Signed and Sealed this

Thirtieth Day of June, 2009

JOHN DOLL
*Acting Director of the United States Patent and Trademark Office*